US005094371A

United States Patent [19]

Takamura et al.

[11] Patent Number: 5,094,371

[45] Date of Patent: Mar. 10, 1992

[54] FINISHING DEVICE FOR STOCKINGS HOSE

[75] Inventors: Toyonori Takamura, Kitakatsuragi; Junko Yamada, Kashihara, both of Japan

[73] Assignees: Takatori Corporation; Takatori Hitech Co., Ltd., both of Nara, Japan

[21] Appl. No.: 593,022

[22] Filed: Oct. 3, 1990

[30] Foreign Application Priority Data

Oct. 3, 1989 [JP] Japan ..... 1-259585

[51] Int. Cl.[5] ..... D06C 5/00

[52] U.S. Cl. ..... 223/76; 223/75; 223/51; 223/60

[58] Field of Search ..... 223/76, 75, 77, 51, 223/60, 52, 61

[56] References Cited

U.S. PATENT DOCUMENTS

| | | | |
|---|---|---|---|
| 2,484,668 | 10/1949 | Backhus | 223/76 |
| 4,166,556 | 9/1979 | Annas, Sr. | 223/76 |
| 4,434,918 | 3/1984 | Hodges | 223/76 X |
| 4,703,877 | 11/1987 | Kuniki et al. | 223/60 |

FOREIGN PATENT DOCUMENTS

| | | | |
|---|---|---|---|
| 5040813 | 3/1980 | Japan | 223/76 |
| 5158374 | 12/1980 | Japan | 223/75 |
| 240965 | 6/1946 | Switzerland | 223/60 |

*Primary Examiner*—Werner H. Schroeder
*Assistant Examiner*—Bibhu Mohanty
*Attorney, Agent, or Firm*—Wenderoth, Lind & Ponack

[57] ABSTRACT

A finishing device for setting and finishing stockings hose such as stockings and panty hose through steam treatment while they are loaded onto templates, the finishing device including a pair of templates which intermittently move, a steam setting section, a stocking take-off section, and opening-closing mechanisms for the templates.

When the templates having a stocking inserted thereon face the steam setting section, the stocking is steam set with steam supply. The steam setting section is composed of a two-part kiln. The templates are folded in two after the setting, and the stocking is taken off the templates at the stocking take-off section for the transfer to the packaging process, with the template open in parallel, ready for the insertion of another stocking.

1 Claim, 7 Drawing Sheets

FINISHING DEVICE FOR STOCKINGS HOSE

BACKGROUND OF THE INVENTION

1. Field of the Invention

This invention relates to finishing devices for setting and finishing stockings hose such as stockings and panty hose (hereinafter, simply and generically referred to as 'stockings') by means of templates and steam.

2. Description of the Related Art

Finishing devices for automatically steam finishing stockings most widely used are so arranged that a piece of stocking is loaded to a template adapted to be circumferentially movable, setting treated at a steam setting section provided in the course of the travel of the template, and after being subjected to drying treatment with the heater of a drying oven, automatically drawn off from the template at a take-off section.

Such conventional finishing devices as above are disclosed in, for example, Japanese Patent Application No. SHO 60-218715 and Utility Model Application No. SHO 60-201733.

Such conventional finishing devices, however, are in any case complex in construction at their steam setting sections and take-off sections and therefore large in size, resulting in higher manufacturing cost and moreover, due to more steam consumption required, higher operating cost, with a further problem that troublesome handling is involved in the transfer of stockings to the packaging process subsequent to the take-off thereof.

Accordingly, it is the primary object of the present invention to provide a finishing device for stockings that is simple in construction at the component sections thereof, thereby allowing the manufacturing cost to be reduced, low in steam consumption, and effective in facilitating the transfer of stockings to the packaging process.

To solve the problems as stated above, the finishing device for stockings according to the present invention is so constructed that templates having two stocking-insertion plates shiftable between juxtaposed and folded positions, i.e. open and closed positions, are arranged so as to be intermittently movable along a circumference, and at positions where the templates are to stop in the circumferential course thereof there are provided in series a steam setting section, a stocking take-off section, and, before and behind the stocking take-off section, opening-closing mechanisms. In this arrangement of the finishing device, the steam setting section comprises a stationary kiln and a movable kiln, the latter movable in advance and retreat with respect to the former, arranged as opposed to each other with a stopped template interposed therebetween, wherein the stationary and movable kilns, when in close proximity to each other, are secured by a lock mechanism with the surroundings airtight in close contact so that the template is accommodated in an internal steam chamber, the stationary kiln having at its lower end a recessed portion for the lower portion of the template to pass therethrough, into and out of which recessed portion an airtight plate also incorporated in the steam setting section comes and goes. The stocking take-off section comprises a stocking push-up mechanism for pinching a stopped template from both sides thereof and moving upward so as to push up the stocking inserted in the template, a pair of endless belts for receiving the stocking pushed up by the stocking push-up mechanism at the opening-closing portion located at the upper ends of the belts with part of the travel portions thereof overlapped each other and the opening-closing portion brought up to just above a stopped template, and then holding and transferring the stocking, insertion means for horizontally extruding the stocking, by an intermediate portion thereof, suspending from the transfer ends of both endless belts, a take-off conveyor for receiving the stocking extruded by the insertion means and transferring it as it is folded in two. The opening-closing mechanisms comprise a vertical plate secured to the lower end of the pivot supporting one stocking-insertion plate of the template as rotatable, a rotator arranged as movable up and down just under a stopped template, and a recessed groove provided on the upper side of the rotator for allowing one stocking-insertion plate to be rotated while being engaged with the vertical plate at the up position of the rotator.

OPERATION

A piece of stocking is inserted into a template adapted to move intermittently. When the template comes up to the steam setting section, the movable kiln makes closer to the stationary kiln, both kilns being secured by the lock mechanism. The lower recessed portion of the stationary kiln is shut off with the airtight plate, thereby sealing the surroundings of the steam chamber defined by the stationary and movable kilns in which the stocking is accommodated. Thus, with the supply of steam into the chamber, the stocking is steam set.

After the stocking is set, the template moves to the opening-closing mechanism, where the rotator moves up and rotates until the recessed groove of the upper side thereof is engaged with the vertical plate and one stocking-insertion plate is turned to overlap the other stocking-insertion plate, the template being folded in two.

The folded-in-two template then moves to stocking take-off section. When the stocking push-up mechanism pinches the stocking by both ends thereof and pushes it up, the opening-closing portion at the upper ends of the endless belts closes to pinch the stocking extruded from the template. The endless belts draw the stocking off the template and transfer it to the transfer end, where the insertion means takes off the stocking as it is longitudinally folded in two, sending it to a conveyor for the transfer thereof to the packaging process.

The template, having the stocking drawn off, in turn faces the following opening-closing mechanism, where one stocking-insertion plate is turned so that both stocking-insertion plates are juxtaposed in parallel, which is the open state, being ready for insertion of another piece of stocking.

DESCRIPTION OF THE PREFERRED EMBODIMENTS

Figure 1:
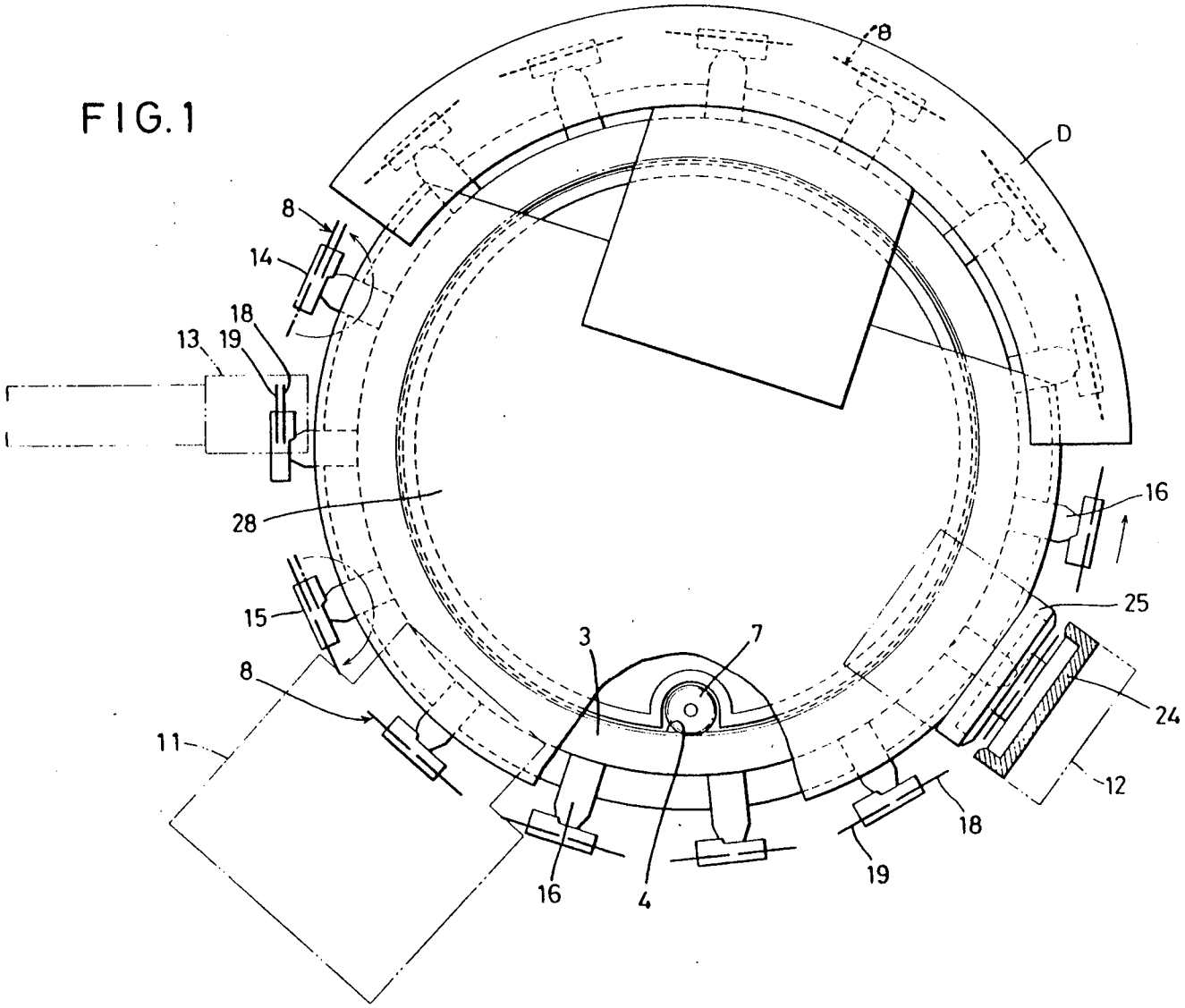
FIG. 1 is a plan view of a finishing device according to the present invention.
Figure 2:
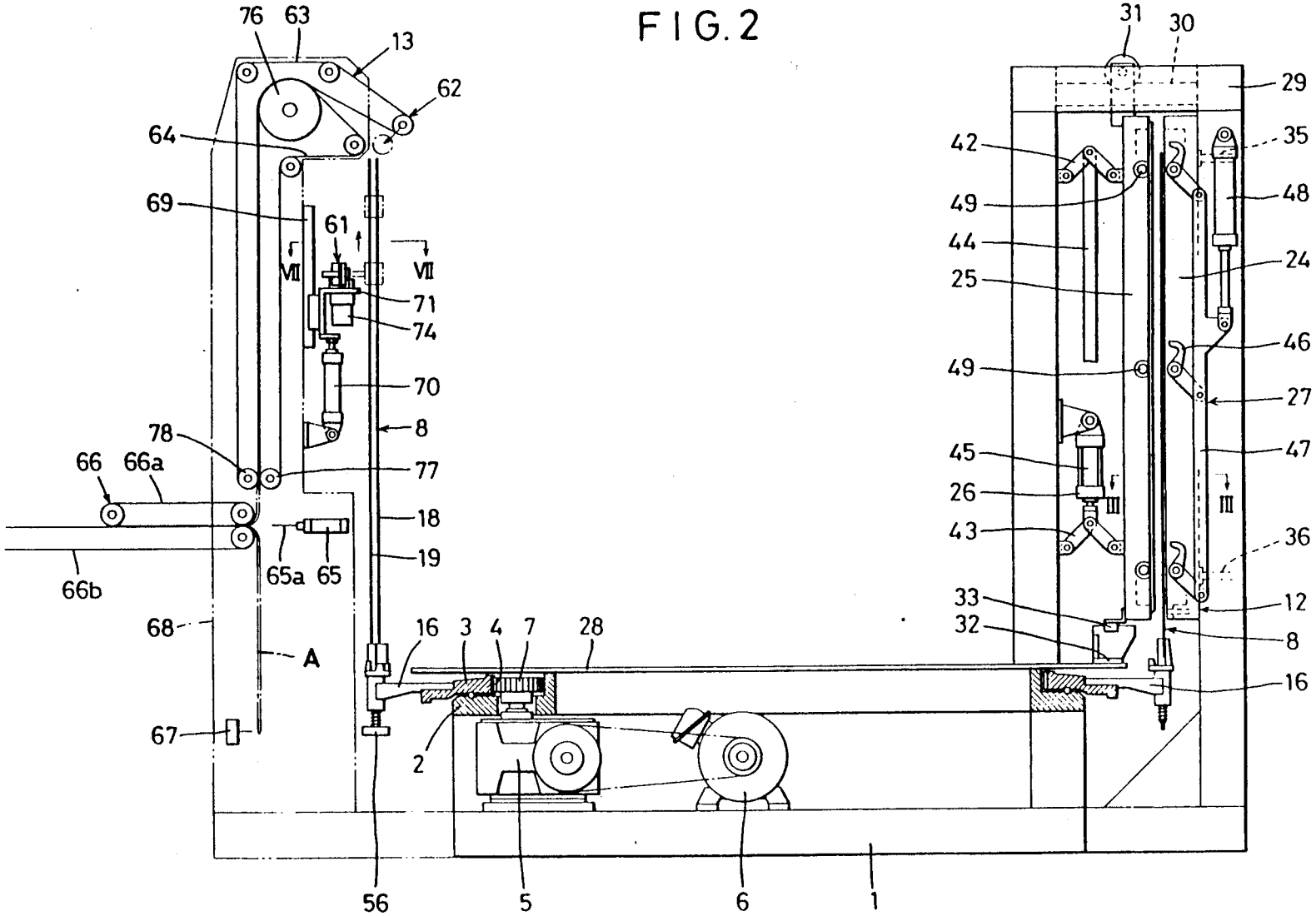
FIG. 2 is a longitudinal elevational view of the same.

Referring now to the drawings for the detailed description of the invention, FIG. 1 is a plan view generally showing a finishing device according to the present invention, while FIG. 2 is a longitudinal sectional view of the same. In the drawings, on a base stand 1 there is fixed a ring-shaped guide rail 2. The gear 4 of an internal gear 3 rotatably supported by the guide rail 2 is adapted to engage with a gear 7 driven by a motor 6 via a speed reducer 5, thereby enabling the internal gear 3 to be intermittently driven.

On the periphery of the internal gear 3, there are provided a number of templates 8 spaced at regular intervals circumferentially, standing erect. The motor 6 is controlled so as to intermittently drive the internal gear 3 at a pitch equal to the spacing interval for the templates 8, so that the templates 8 are adapted to move along the circumference having its center at the axis of the pivot of the internal gear 3.

In FIG. 1, the templates 8 are intermittently driven counterclockwise as indicated by the arrow in the figure, wherein, at positions where the templates are to stop, there are provided in series along the direction of intermittent rotation a loading section 11 for loading a stocking A into a template 8, a steam setting section 12 for setting the stocking loaded into the template 8 with steam treatment, a drying oven D for drying the stocking subsequent to setting, a stocking take-off section 13 for taking the stocking A off the template 8 after drying, and opening-closing mechanisms 14, 15 for the templates 8 located before and behind the stocking take-off section 13.

First, as shown in FIG. 2 and FIGS. 8 to 13, a template 8 is so arranged that a vertical pivot 17 is rotatably supported by a bracket 16 secured to the internal gear 3, on which bracket 16 there are provided a pair of stocking-insertion plates 18, 19 shaped into vertically long flat plates, standing erect.

One stocking-insertion plate 18 is supported at its lower end by a rotating plate 20 secured to the upper end of the pivot 17, thereby allowing the plate 18 to be freely rotated about the pivot 17 as well as to be freely moved up and down integrally with the pivot 17, while the other stocking-insertion plate 19 is secured erect on the bracket 16 with the aid of a fixing plate 21 interposed therebetween.

Accordingly, one stocking-insertion plate 18 is rotatable from the open position where it is juxtaposed in parallel with the other stocking-insertion plate 19 to the closed position where one is opposed to the other.

In order that one stocking-insertion plate 18 may be secured to each of the open and closed positions, on the top of the bracket 16 there are provided a pair of protrusions 22, 22 to which the lower portion of the rotating plate 20 fits in the open position, and also a pair of protrusions 23, 23 to which the lower portion of the rotating plate 20 fits in the closed position. In this arrangement, the lower edge of the rotating plate 20 is pushed up above the upper end of the protrusions 22 or 23, whereby one stocking-insertion plate 18 can be opened and closed.

Next, the stocking-loading section 11 allows an operator to load a stocking A manually from above into both stocking-insertion plates 18 and 19 of a stopped template 8; otherwise, the automatic stocking-inserting inspection system of the conventional finishing device disclosed in the above-mentioned Japanese Utility Model Application No. SHO 60-201733 may be used for this application.

The steam setting section 12 is located where the template 8 stops over a plurality of pitches from the stocking-loading section 11, wherein, as shown in FIGS. 1 to 6, a stationary kiln 24 and a movable kiln 25 are disposed opposite to each other, the movable kiln 25 being adapted to be moved by an advance-retreat mechanism 26 and further, when in proximity to the stationary kiln 24, to be secured by the lock mechanism 27.

The stationary kiln 24 mentioned above is secured to a frame 29 provided on the upper portion of both the base stand 1 and a top plate 28 spanning over the guide rail 2, while the movable kiln 25 is held by a roller 31 as its upper end is hung from a rail 30 provided to the upper portion of the frame, the lower end thereof being led by a rail plate 32 and a rotor 33 provided on the top plate 28.

Both of the stationary and movable kilns 24, 25 are of such a rectangular shape that has a longitudinal length covering from the upper end of the template 8 to the lower portion thereof and a width slightly exceeding that of the template 8, each of the kilns having therein steam chambers **24*a*, 25*a*, respectively, so as to provide openings in their opposing faces. On the periphery of the opening of the movable kiln 25, there is provided a packing 34 of pressure resistance and heat resistance as shown in FIG. 3, whereby the steam chambers 24*a*, 25*a* are sealed when moving close to the stationary kiln 24**.

Figure 3:
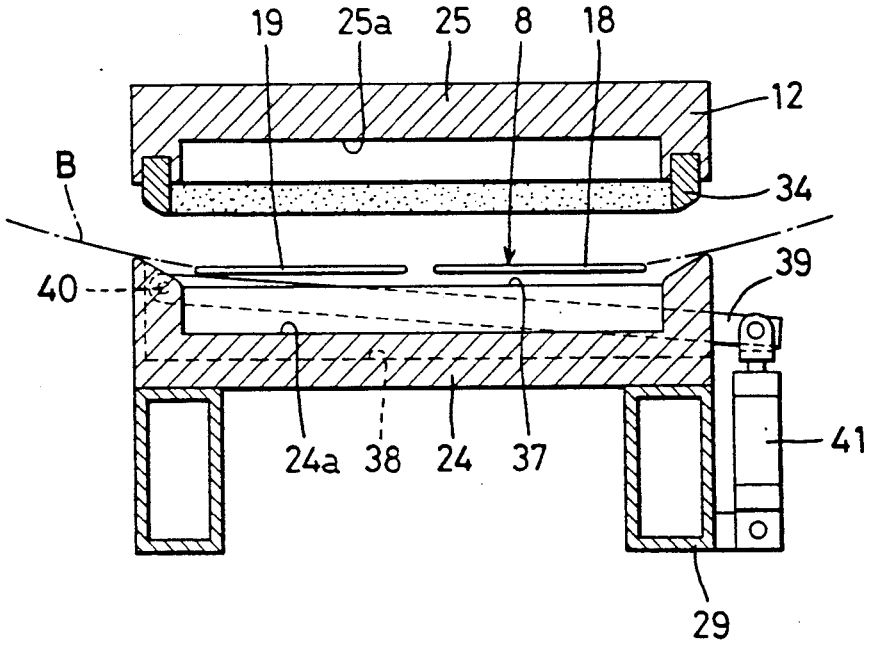
FIG. 3 is a transverse sectional view taken along arrows III—III in FIG. 2.

The stationary kiln 24, as shown in FIG. 3, is securely disposed to the frame 29 so as to make close thereto to such an extent that its opening end will not make contact with a moving track B along which the template 8 intermittently moves.

The movable kiln 25 is, when in its retreat position, opposed to the stationary kiln 24 with the above-mentioned moving track B interposed therebetween, so that the template 8 may have an access between the stationary kiln 24 and the movable kiln 25 without any interference.

The stationary kiln 24 has a steam supply pipe 35 connected thereto at its upper portion and a steam exhaust pipe 36 at its lower portion, respectively, whereby the steam chambers **24*a*, 25*a* in which the template 8 is accommodated are supplied with steam for setting the stocking A inserted into the template 8** with steam treatment.

At the lower end of the opening face of the stationary kiln 24, there is provided a recessed portion 37 for accommodating the template 8 and allowing it to pass therethrough when the template is pinched, and also provided a notched portion 38 ranging inside of the recessed portion 37, wherein an airtight plate 39 is incorporated in the notched portion 37.

The airtight plate 39, as shown in FIG. 3, has its front end pivotally secured to the stationary kiln 24 using a pin 40 horizontally swingably at one end of the recessed portion 37, and its rear end protruding from the notched portion 38 is communicated with a cylinder 41 attached to the frame 29, thereby allowing the airtight plate to be swung around the pin 40 by virtue of extension and contraction of the cylinder 41.

Figure 4:
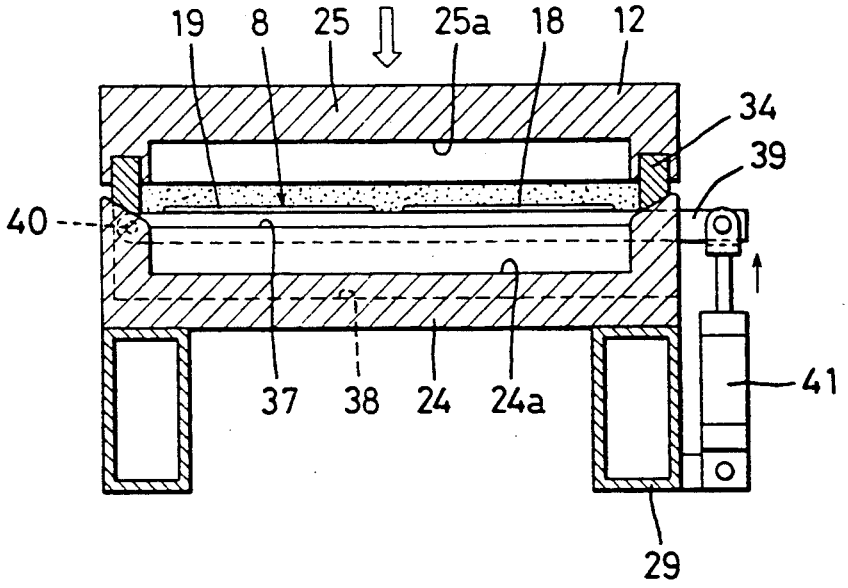
FIG. 4 is a similar transverse sectional view showing the closed state of the same.
Figure 5:
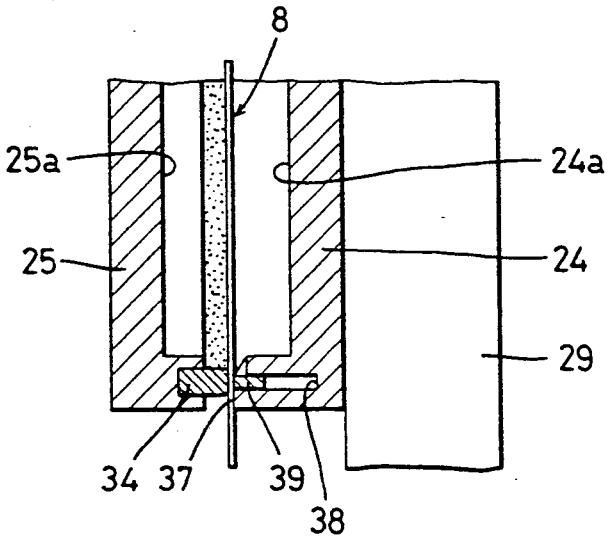
FIG. 5 is a sectional view taken along arrows V—V in FIG. 4.
Figure 6:
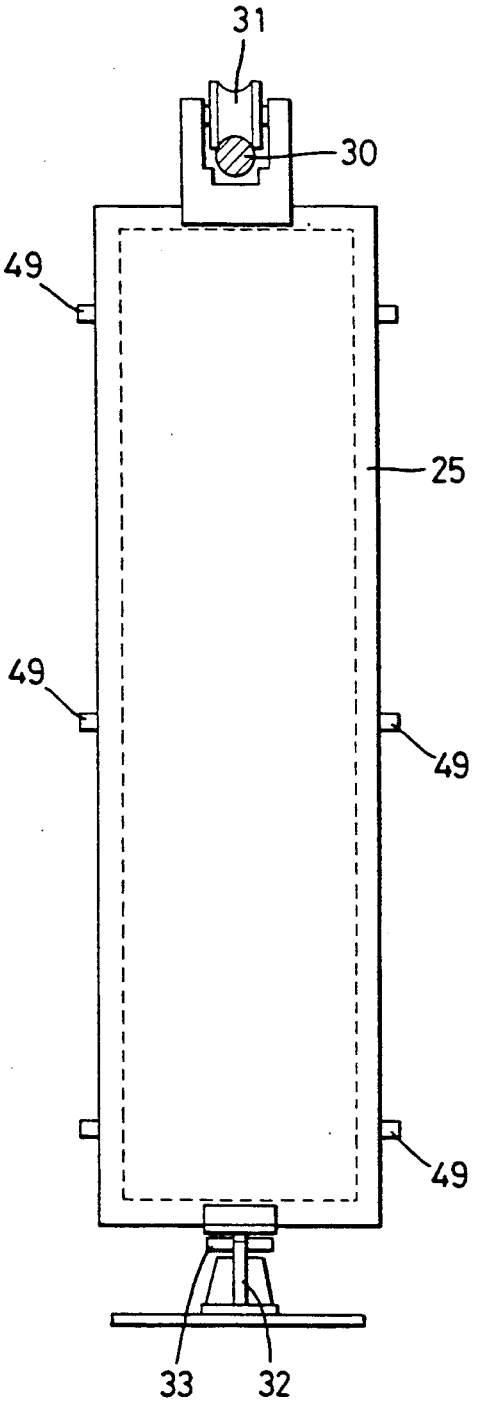
FIG. 6 is a longitudinal sectional view of the rear side of a movable kiln.

The airtight plate 39 is held slanting within the notched portion 38, as shown in FIG. 3, when the movable kiln 25 moves apart therefrom to its retreat position, the plate being away from the moving track B, while, when the movable kiln 25 advances until it faces in contact the stationary kiln 24, the plate 39 is swung toward the movable kiln 25 by virtue of the extension of the cylinder 41 so as to urge the template 8, as shown in FIG. 4, in close contact with the packing 34, thereby sealing the recessed portion 37.

In consequence, the lower penetrating portion with respect to the stationary kiln 24 and the movable kiln 25 is sealed with the airtight plate 39, the steam chambers 24*a*, 25*a* being airtight completely excluding any leakage of steam.

The advance-retreat mechanism 26 shown in the figure is so arranged that the movable kiln 25 is communicated with the upper and lower portions of the frame 29 using double links 42, 43 linked using a connecting rod 44, one double link 43 being communicated with a cylinder 45 so that the extension and contraction of the cylinder 45 causes the double links 42, 43 to bend and thereby the movable kiln 25 to advance and retreat horizontally, whereas another arrangement may here be applied, for example, the frame 29 and the movable kiln 25 are direct communicated with each other using a cylinder for the advance-retreat movement.

The lock mechanism 27 is so arranged that hook rods 46 are pivotally secured to the upper, lower, and intermediate portions of both sides of the stationary kiln 24 as swingable, a connecting rod 47 for interlocking each hook rod 46 is linked with a cylinder 48 attached to the frame 29 so as to impart swing thereto in synchronization with each hook rod 46, and engage pins 49 are fixed at positions corresponding to hook rods 46 on both sides of the movable kiln 25. With the movable kiln 25 in pressure contact with the stationary kiln 24, the hook rods 46 are engaged with engage pins 49, whereby both the stationary kiln 24 and the movable kiln 25 are secured so as to prevent any leakage of steam even with increase in the internal pressure of the steam chambers 24*a*, 25*a* due to steam supply.

Figure 14:
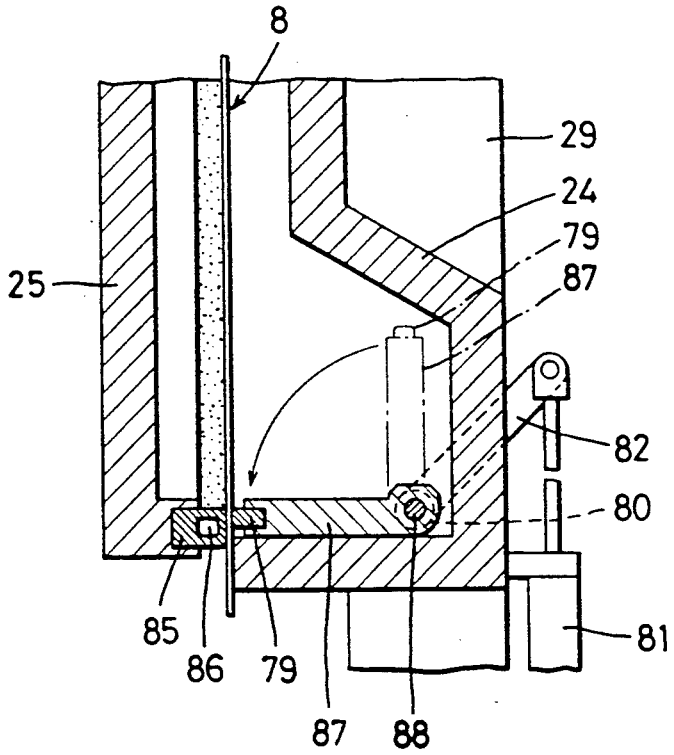
FIG. 14 is a main-part sectional view showing another embodiment of the steam setting section.
Figure 15:
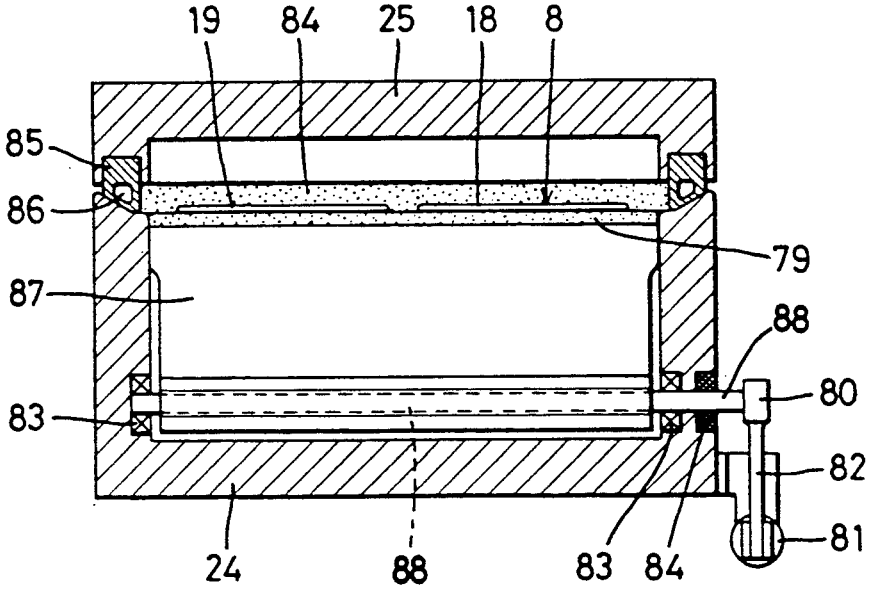
FIG. 15 is a transverse sectional view of the same.

In addition, FIGS. 14 and 15 show another embodiment of the airtight plate 39 for sealing the lower penetrating portion for the stationary kiln 24 and the movable kiln 25.

In the figures, the airtight plate here used is an airtight plate 39 of swinging type, which is swingably supported by a pivot 88 at its one end toward the lower space within the stationary kiln 24, and at the other end there is provided a packing 79.

The pivot 88 has its one end led out of the stationary kiln 24, the leading tip of which has a boss portion 80 provided, the boss portion 80 being linked with a connecting rod 82 derived from a cylinder 81.

The above pivot 88 is provided with bearings 83, 83 in the inner wall of the stationary kiln 24, rendering the pivot rotatable, and also with a seal 84 in the outer wall of the same, preventing the steam therewithin from escaping.

In FIG. 14, the swinging airtight plate 87 is normally located as indicated by dotted lines, being adapted to help rotate the pivot 88 through the action of the cylinder 88 via the connecting rod 82 and the boss 80, and stop at the position as indicated by continuous lines, sealing the passing recessed portion 37 of the lower portion of the template with the packing 79.

A packing 85 provided on the periphery of the opening of the movable kiln 25 is equipped with a hollow hole 86. The hollow hole 86 is filled when in close contact with the stationary kiln 24, thus rendering the close contact condition of the clearance of the template 8 more successful.

In particular, when the recessed portion 37 is sealed using the swinging airtight plate 87, the steam pressure injecting from above serves to press down the template 8 from the upper side thereof, advantageously allowing the most successful close contact condition for the template 8.

Next, the drying oven D is arranged subsequent to the steam setting section 12 to allow the template 8 to pass therethrough over a plurality of moving pitches, being adapted to dry the setting-treated stocking with a fan heater incorporated therein.

In this case, a far infrared radiation heater, if used as the heat source of the drying oven D, will enhance the drying effect.

One opening-closing mechanism 14 located before the stocking take-off section 13 is adapted to fold the template 8 in two after drying treatment, preparing for the take-off of a stocking, while the other opening-closing mechanism 15 located behind the stocking take-off section 13 is to open the template 8 having a stocking taken drawn off, making ready for the insertion of another piece of stocking.

Both opening-closing mechanisms 14, 15, as shown in FIGS. 8 to 11, are so arranged as to be retained by a plurality of guides 50 and an elevating pivot 51 provided at the stationary portion of the base stand 1 and the like, and mounted to both ends of an elevating bracket 53 to which up-and-down movement is imparted by a cylinder 52 interposed between the fixed portion and the bracket. The opening-closing mechanisms further includes a rotator 55 disposed on the upper side of the bracket 53 so as to be rotated with the cylinder 54, and a vertical plate 56 secured to the lower end of the pivot 17 for the template 8, the rotator 55 having on its upper side a recessed groove 57 with which the vertical plate 56 engages in its elevated state.

The two opening-closing mechanisms 14, 15 are adapted to allow the recessed groove 57 of the rotator 55 to be externally fitted and engaged with the vertical plate 56 when moved up with the extension of the cylinder 52 and at the same time to push up the pivot 17 against the elasticity of a spring 58 until one stocking-insertion plate 18 is lifted above the protrusion 22 or 23, thereby releasing the fixed condition of the one stocking-insertion plate 18, wherein the rotating cylinder 54 causes the rotator 55 to rotate up to approximately 180° so that the front opening-closing mechanism 14 acts to fold the template 8 in two, while the rear opening-closing mechanism 15 acts to open the template 8, and thereafter, the opening-closing mechanisms 14, 15 return to the lowered position thereof with the contraction of the cylinder 52, with the result that one stocking-insertion plate 18 is released from the push-up to lower until secured with the protrusions 22, 22 or 23, 23 fitted thereto.

Figure 7:
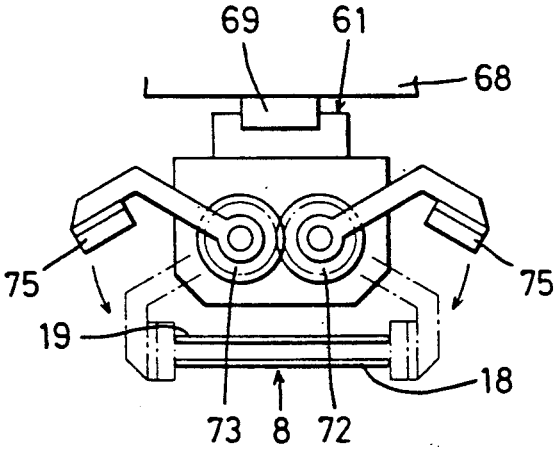
FIG. 7 is a transverse sectional view taken along arrows VII—VII in FIG. 2.
Figure 8:
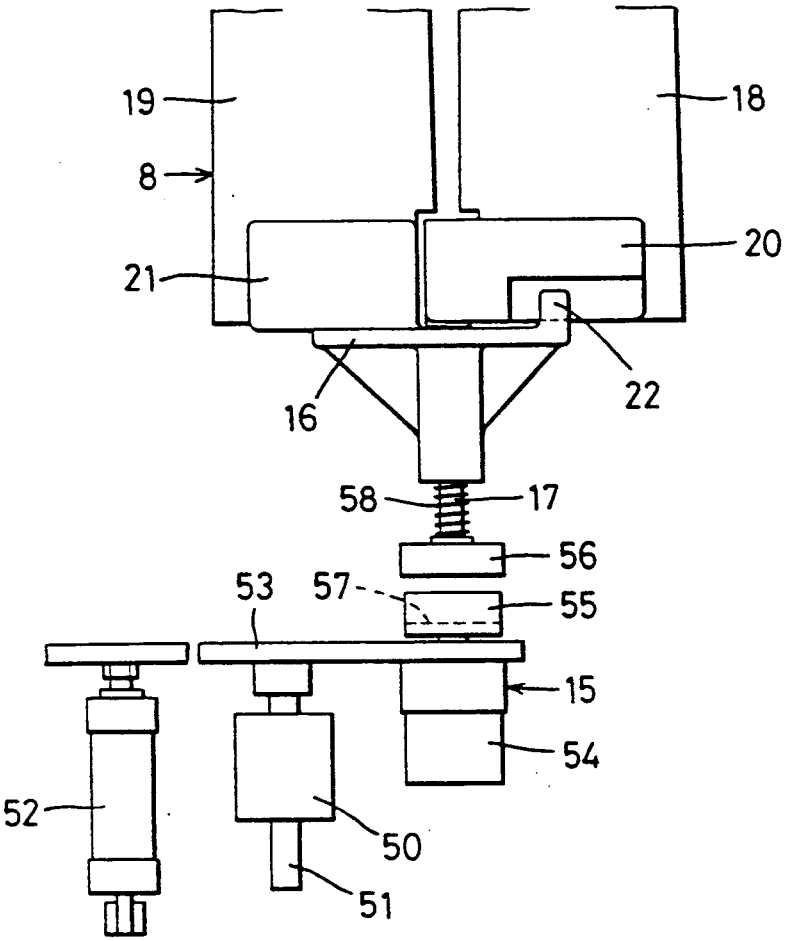
FIG. 8 is an enlarged elevational view showing the open state of an opening-closing mechanism.
Figure 9:
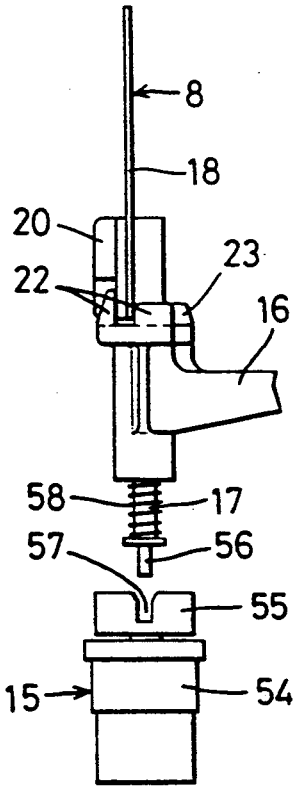
FIG. 9 is a left side view of FIG. 8.
Figure 10:
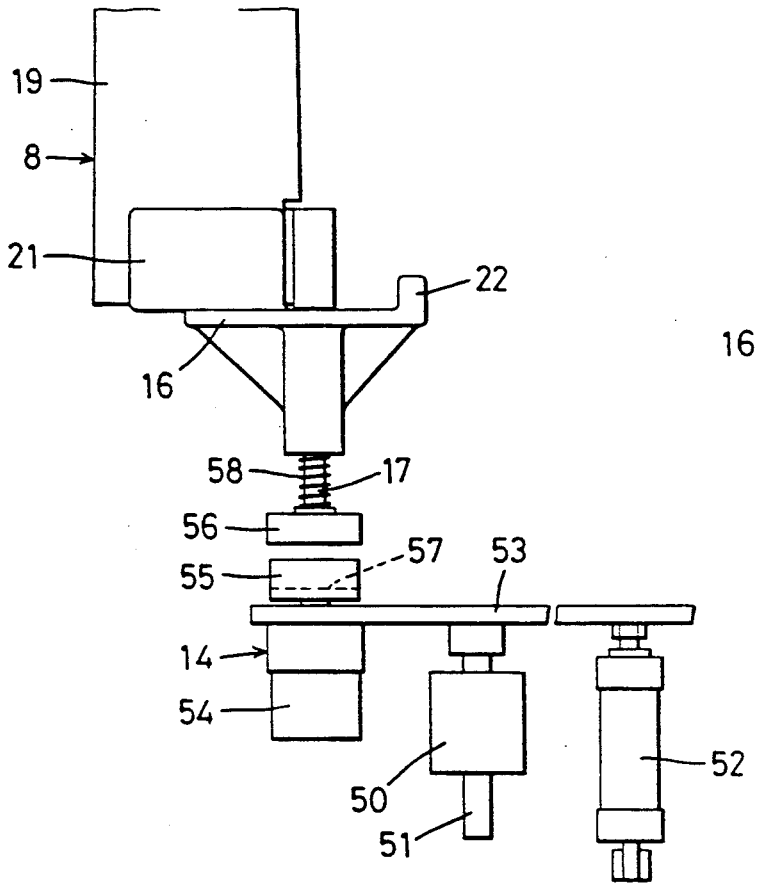
FIG. 10 is an enlarged elevational view showing the open state of the opening-closing mechanism.
Figure 11:
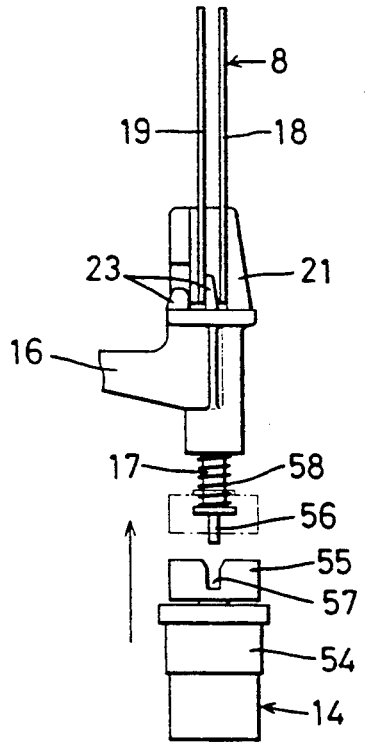
FIG. 11 is a right side view of FIG. 10.
Figure 12:
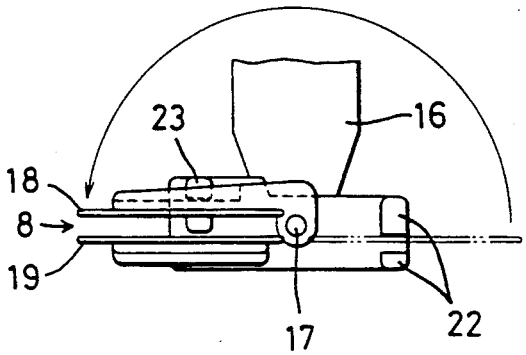
FIG. 12 is a plan view showing a closed template.
Figure 13:
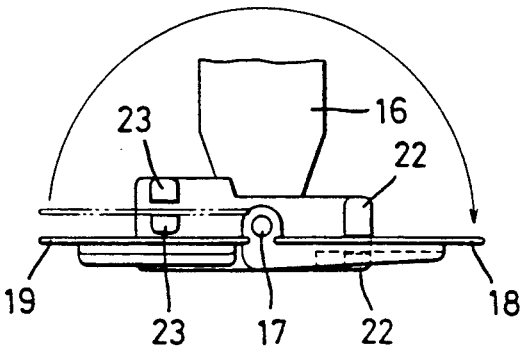
FIG. 13 is a plan view showing an open template.

The stocking take-off section 13, as shown in FIGS. 2 and 7, comprises a stocking push-up mechanism 61 disposed on the outer side of a folded-in-two stopped template 8, a pair of endless belts 63, 64 disposed so that an upper opening-closing portion 62 comes immediately above the folded-in-two template 8, insertion means 65 and a take-off conveyor 66 disposed at the transfer-side end of the two belts 63, 64, and a sensor 67 for detecting the lower end of the stocking A suspending from the transfer-side ends of the two endless belts and then actuating the insertion means 65.

The stocking push-up mechanism 61 is formed in such a way that a vertical rail 69 is provided to a support frame 68, a pair of gears 72, 73 are pivotally secured in engagement on a bracket 71 adapted to move up and down along the rail 69 with a cylinder 70 so that one gear 72 can be reversely driven with a rotating cylinder 74 attached to the lower side of the bracket 71, and on the peripheries of both gears 72, 73 there are protrusively provided pinching pats 75, 75 for pinching the folded-in-two template 8 from both sides.

Both pinching pats 75, 75 are adapted to close in the lowered position to pinch the folded-in-two template 8 widthwise from both sides thereof, as indicated by dash-and-dotted lines in FIG. 7, and moves up as pinching the template, thereby pushing up the stocking from the template.

Both endless belts 63, 64 are attached to the support frame 68 in such a way that the vertical portions thereof traveling between a larger-in-diameter pulley 76 and smaller-in-diameter pulley 77, 78 may overlap with each other to travel equally in the speed and direction thereof. The turnaround portion of one endless belt 63 located on the outer side of the upper portion in upper end of the belt is allowed to be swingable, and in combination with the upper end turnaround portion of the other endless belt 64, forms up the opening-closing portion 62, at which opening-closing portion 62 the stocking extruded from the upper end of the template 8 by the stocking push-up mechanism 61 is received.

The take-off conveyor 66 is formed of endless belts 66*a*, 66*b* overlapping each other up and down, while the insertion means 65 serves to push in the suspending stocking between the conveyors 66*a* and 66*b* by an insertion plate 65*a* attached to the tip of the insertion means so that the folded-in-two stocking is further folded in two perpendicularly and then supplied to the take-off conveyor 66.

Thus, the stocking further folded in two in the take-off conveyor 66 is as a whole of a small size, thereby advantageously facilitating the work in packaging process to be performed on the take-off side of the conveyor 66.

In addition, a sensor 67 is adjustable up and down in its position, whereby the position thereof can be selected so that the folding state of stockings may optionally be varied in correspondence to the packaging process.

With the arrangement of the finishing device of the present invention as shown above, each template 8 is moved by the motor 6 in such a way that it intermittently travels a constant space interval for every stoppage of a constant time interval. At the stocking-loading section 11, the template 8 is loaded with a stocking A from above. When the template 8 stops facing the steam setting section 12, the movable kiln 25 standing by in its retreat position advances up to make contact with the stationary kiln 24, allowing the stocking to be accommodated in the steam chambers 24*a*, 25*a* sealed with the packing 34 and the airtight plate 39. At the same time, the lock mechanism 27 is actuated to secure the movable kiln 25 to the stationary kiln 24, wherein the stocking is setting treated with the steam supplied within the steam chambers 24*a*, 25*a*. After a predetermined time of setting treatment, the lock mechanism 27 is released and the movable kiln 25 returns to its retreat position. Then, the template 8 moves by one pitch and another template 8 comes into the steam setting section 12, while the setting-treated stocking goes into the drying oven D for drying.

The template 8, having left the drying oven D, advances to the opening-closing mechanism 14, where the stocking-insertion plate 18 is folded with the stocking folded in two. The template 8 as it is then moves to the following stocking take-off section 13.

When the folded-in-two template 8 stops at the stocking take-off section 13, the stocking push-up mechanism 61 is actuated to push up the stocking out of the upper end of the template 8. The stocking as such then goes into the opening-closing portion 62 of the endless belts 63, 64, where it is drawn off from the template 8 in the closed state of the opening-closing portion 62 and sent out as pinched by the two endless belts 63, 64.

Due to that the sensor 67 detects the lower end of the stocking suspending from the transfer end of the two endless belts 63, 64, the insertion means 65 is actuated extendedly so as to allow the insertion plate 65*a* to take out the stocking by the intermediate portion thereof and push it in the conveyor 66, with the result that the stocking is further folded in two perpendicularly for the transfer to the packaging process.

The template having the stocking drawn off goes further to the opening-closing mechanism 15, where both stocking-insertion plates 18, 19 are rendered open, allowing the template to move to the subsequent stocking-loading section 11.

EFFECTS

As described heretofore, according to the present invention, stockings can be steam set and taken off automatically, so that the steam setting section, stocking take-off section, and template opening-closing mechanisms before and behind the take-off section may be simplified in construction to a substantially large extent, thereby enabling the manufacturing cost to be reduced.

Moreover, since the stationary and movable kilns are used to accommodate a template for the steam setting, the setting treatment of stocking requires only the minimum steam consumption, making feasible the reduction in finishing cost.

Further, the way that stockings are taken off as folded in two with the aid of the take-off conveyor helps facilitate the subsequent packaging process.

I claim:

1. A finishing device for stockings in which templates having two stocking insertion plates have means to move along a circumferential course along which course said templates intermittently stop at a loading station, a steam setting station, a drying station, and a stocking taking-off station, wherein said steam setting station comprises a kiln comprised of a stationary kiln half and a movable kiln half which kilns are arranged facing each other with forcing means to move the two kiln halfs into a sealed touching relationship forming an internal steam chamber therein into which steam chamber said templates pass through, said steam chamber containing airtight plates which are releaseably engaged by locking means, said stocking take-off section comprising a stocking push-up mechanism for pinching one of said templates from both sides thereof and moving upward so as to push up a stocking placed over said template, insertion means to extrude and remove said stocking from said template and endless belts to receive and transfer removed stockings, said templates provided with shiftable means to hold said templates between open and closed positions on said circumferential course.

* * * * *